United States Patent [19]

Rayner

[11] Patent Number: 5,004,211

[45] Date of Patent: Apr. 2, 1991

[54] FENCE DROPPER

[76] Inventor: Ernest Rayner, GPO Box 327, Katherine, N.T. 0851, Australia

[21] Appl. No.: 398,652

[22] Filed: Aug. 25, 1989

[30] Foreign Application Priority Data

Aug. 26, 1988 [AU] Australia ..... PJ0064

[51] Int. Cl.[5] ..... E04H 17/02

[52] U.S. Cl. ..... 256/47; 256/48; 256/35

[58] Field of Search ..... 256/35, 33, 47, 48, 256/57; 403/397

[56] References Cited

U.S. PATENT DOCUMENTS 3,671,017 6/1972 Sachs ..... 256/47

FOREIGN PATENT DOCUMENTS 403826 12/1967 Australia ..... 256/48

21248 of 1911 United Kingdom ..... 256/33

*Primary Examiner*—Andrew V. Kundrat

*Attorney, Agent, or Firm*—Ostrolenk, Faber, Gerb & Soffen

[57] ABSTRACT

A fence dropper formed from a length of rod or wire bent to a central generally linear portion having arms extending at right angles from either end of the central portion is provided with loops at either end of the central portion and one or more intermediate loops between the loops at either end. Each loop is designed to engage a parallel fence wire when the arm portions are at right angles to the fence wires, and to restrain the fence wire within an aperture defined by the loops when the arms are rotated to lie alongside the top and bottom end wires. Provision is made to engage the free ends of the arms with the fence wires when in the parallel configuration.

7 Claims, 2 Drawing Sheets

FENCE DROPPER

This invention relates to a fence dropper devised particularly to engage and separate the Parallel wires of a multi-strand wire fence.

BACKGROUND OF THE INVENTION

It is well known to provide fence droppers of various types to separate and support the various strands of a multi-strand wire fence. Early examples of fence droppers comprised timber battens into which were nailed a number of staples each engaged with one strand of the fence. Droppers of this nature were expensive both to manufacture and to install and were generally replaced by metal rod or wire type fence droppers of the type described in Australian Patent Specification 402869. Fence droppers of the type described in that patent have a central rod portion with transverse arms at either end shaped so that the top and bottom wires of the fence can be engaged with the dropper by entwining the wires about the lateral arms. Loops are provided in the intermediate sections of the central portion adapted to engage and support the intermediate wires of the fence. Fence droppers of this type have the disadvantage that tightly strained upper and lower wires in a fence are often difficult to entwine about the lateral arms requiring the use of a tool such as a screwdriver to wind the arms onto the top and bottom wires. This procedure is awkward and time consuming, and can damage the wires.

SUMMARY OF THE INVENTION

The present invention therefore provides a fence dropper formed by bending a length of rod and adapted to engage at least the top and bottom wires of a multi-strand wire fence, said fence dropper comprising a central generally linear portion having loops formed at either end and arm portions extending from the loops parallel to one another laterally of the central portion and terminating at their free ends in wire engagement means; the loops being shaped to engage the top and bottom wires by longitudinal movement of the dropper laterally relative to each wire with the arms orientated at right angles to the wires, and to provide vertical restraint for each wire when the central portion of the dropper is rotated about its own axis until the arms are substantially parallel to the wires.

Preferably additional loops similar in configuration to the loops formed at either end of the Central portiOn are formed at intermediate locations in the central portion adapted to support the intermediate wires of a multi-strand fence.

Preferably the wire engagement means comprise a U-bend at the free end of each arm, each U-bend having a nose portion and an open end opening laterally of the respective arm portion and orientated such that the nose portion leads when the central portion of the dropper is rotated about its own axis to engage the top and bottom wires.

Preferably the U-bends are narrowed or necked adjacent their open ends so that they may be clipped in place over the top and bottom wires of the fence.

DESCRIPTION OF THE DRAWINGS

Notwithstand any other forms that may fall within its scope, one preferred form of the invention will now be described by way of example only with reference to the accompanying drawings in which.

DESCRIPTION OF THE PREFERRED EMBODIMENT

Figure 1:
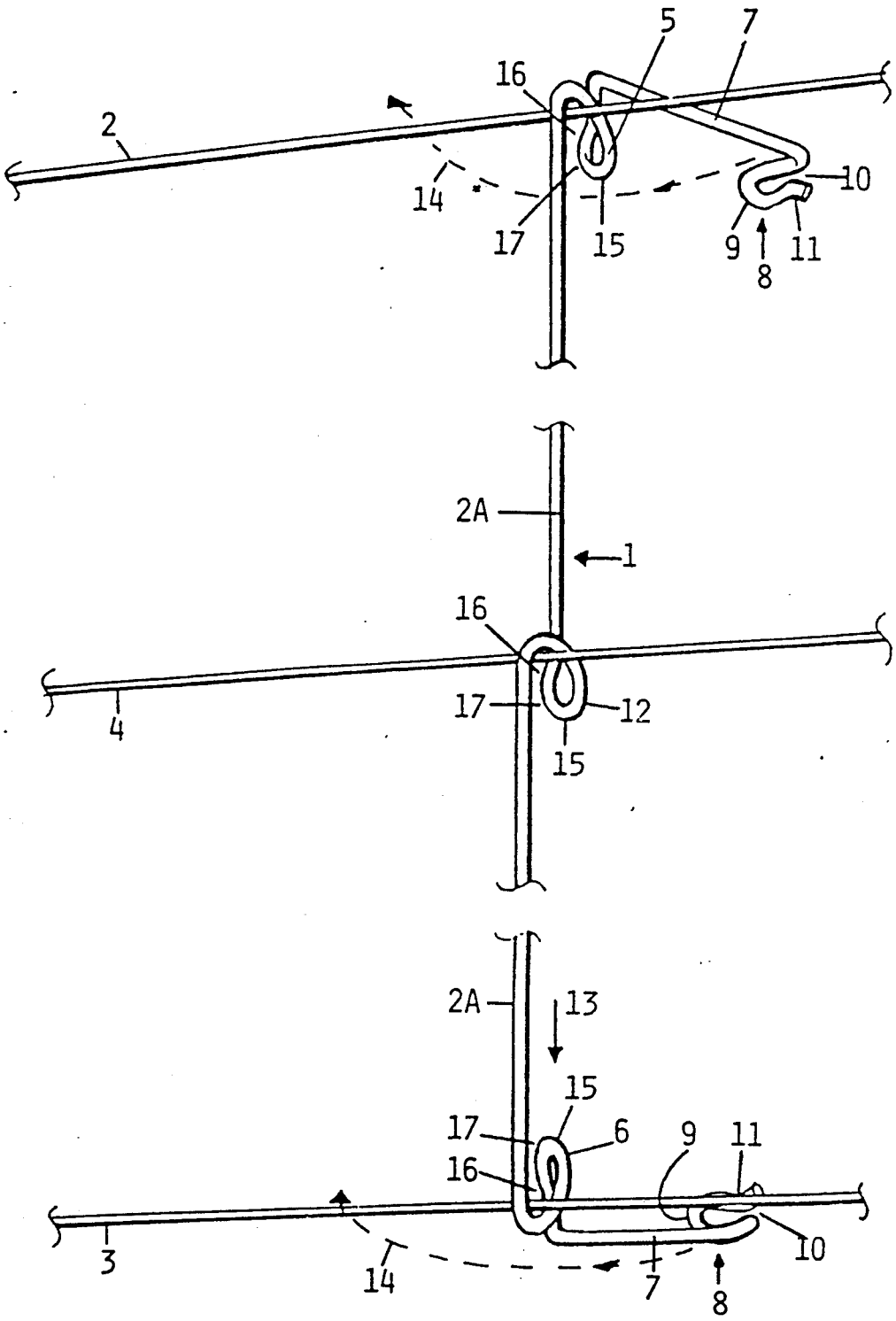
FIG. 1 is an elevation of a portion of a three wire multi-strand fence showing a fence dropper according to the invention slideably engaged with the fence wires.

In the preferred form of the invention a fence dropper 1 is formed by bending a length of wire or rod to a shape that is adapted to engage at least the top wire 2 and the bottom wire 3 of a multi-strand wire fence and preferably also any intermediate wires typically shown at 4. The fence dropper comprises a central portion 2A having loops 5 and 6 formed at either end. The rod forming the fence dropper extends outwardly from the loops in arm portions 7 formed parallel to one another and laterally of the central portion 2A and terminating at their free ends in wire engagement means. The engagement means may simply comprise a downturned portion at the end of the top arm and an upturned portion at the end of the bottom arm, but in the preferred form of the invention they comprise U-bends 8 each having a nose portion 9 and an open end 10 opening laterally of the arm portions 7. In the preferred form of the invention the U-bends are further provided with a necked or re-entrant portion 11 arranged to provide a spring clip action over the top and bottom wires 2 and 3 as will be described further below.

The dropper may also be provided with one or more intermediate loops 12 located in positions on the central portion 2A corresponding to the location of intermediate fence wires 4.

The loops 5 and 12 are shaped to slideably engage the fence wires by longitudinal movement of the dropper laterally across the wires with the arms orientated at right angles to the wires as shown in FIG. 1. The longitudinal movement of the dropper is indicated by arrow 13. The lower wire 3 is then raised and dropped laterally into the lower loop 6.

Figure 2:
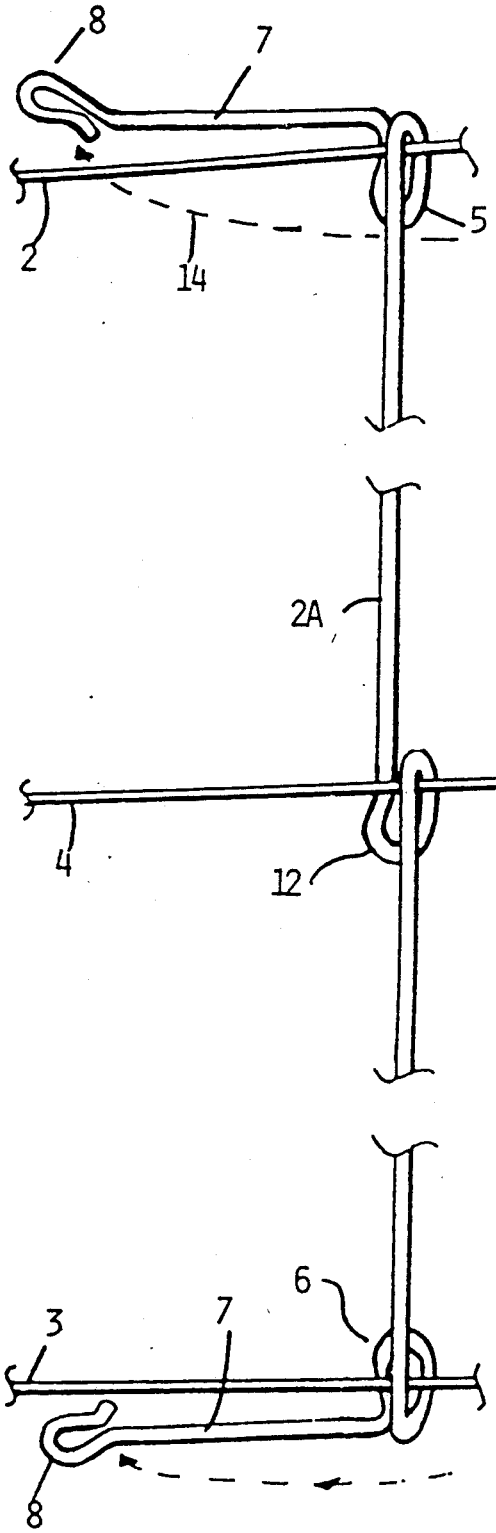
FIG. 2 is a similar view to FIG. 1 showing the fence dropper rotated through 90° with the arms parallel to the fence wires.
Figure 3:
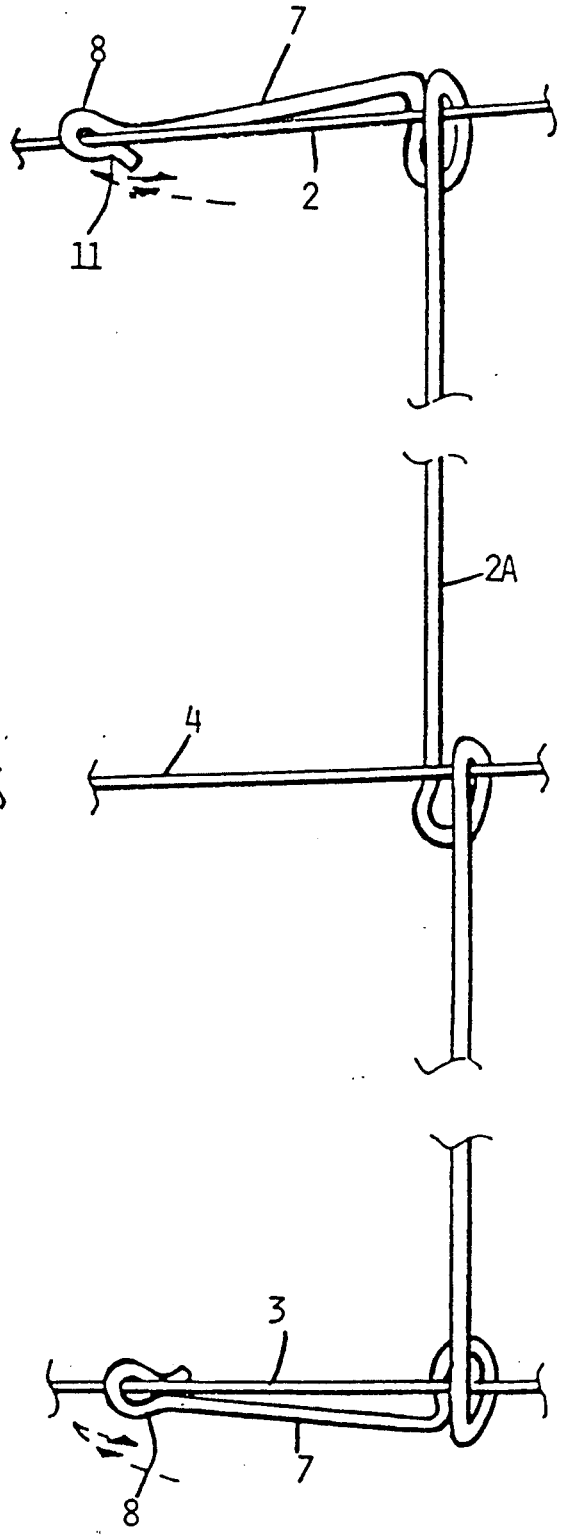
FIG. 3 is a similar view to FIG. 2 showing the U-bends at the end of the arms engaged with the top and bottom fence wires.

The loops are shaped as shown in the drawings so that when the fence dropper is engaged with the fence wires in this manner, the dropper may be rotated axially about its central portion as shown by arrows 14 to bring the arms parallel with the top and bottom wires 2 and 3 as shown in FIG. 2. The shape of the loops 5, 6 and 12 are such that when the dropper is rotated in this manner, the loops effectively lock around the fence wires preventing either upward or downward movement of the wires relative to the dropper. To this end each loop comprises a first portion 15 bent through greater than 180° and defining a necked aperture 16 between the first portion and the adjacent central portion 2A. The wire is shaped to form a re-entrant neck 17 to each aperture 16. It is into this aperture that the fence wire is engaged with the dropper in the position shown in FIG. 1, i.e. with the arms 7 at right angles to the fence wires. When the dropper is rotated about the axis of its central portion, rotation of the plane of the loops 15 causes the neck 17 of each aperture 16 to close below wires ; 2 and 4 and above wire 3, effectively restraining the wires within the apertures 16. Once the fence dropper has been rotated into this position the U-bends 8 at the ends of the arms 7 may be engaged with the top and bottom wires 2 and 3 as shown in FIG. 3 by reversing the rotation of the dropper and entering the top and bottom wires into the open ends 10 of the U-bends. Due to the necked nature of the U-bends as shown at 11, the wires can be clipped in place within the U-bends securely locating and engaging the top and bottom wires in the U-bends and locking the dropper securely into place on the fence wires.

In this manner a fence dropper is provided which is both inexpensive and simple to manufacture and which furthermore is quick and simple to engage with the wires of a fence without the use of any external tools. By the nature of the dropper, its engagement with the fence wires does not require any deformation of the wires or any twisting about the arms of the dropper and therefore the use of fence droppers of this tYpe according to the invention does not result in any damage to the wires of the fence.

What I claim is:

1. A fence dropper formed by bending a length of rod and adapted to engage at least the top and bottom wires of a multi-strand wire fence, said fence dropper comprising a central generally linear portion having loops formed at either end and arm portions extending from the loops parallel to one another laterally of the central portion and terminating at their free ends in wire engagement means, the loops being shaped to engage the top and bottom wires by longitudinal movement of the dropper laterally relative to each wire with the arms orientated at right angles to the wires, and to provide vertical restraint for each wire when the central portion of the dropper is rotated about its own axis until the arms are substantially parallel to the wires.

2. A fence dropper as claimed in claim 1 wherein the wire engagement means comprise a U-bend at the free end of each arm, each U-bend having a nose portion and an open end opening laterally of the respective arm portion and orientated such that the nose portion leads when the central portion of the dropper is rotated about its own axis to engage the top and bottom wires.

3. A fence dropper as claimed in claim 2 wherein the U-bends are narrowed or necked adjacent their open ends so that they may be clipped in place over the top and bottom wires of the fence.

4. A fence dropper as claimed in claim 1 wherein additional loops similar in configuration to the loops formed at either end of the central portion are formed at intermediate locations in the central portion adapted to support the intermediate wires of a multi-strand fence.

5. A fence dropper as claimed in claim 1 wherein each said loop comprises interconnected first and second portions each being bent through an angle greater than 180° defining a necked aperture between the first portion and the adjacent central portion, the neck of each aperture being sized and orientated such that a fence wire may pass through the neck into the aperture when the arms are orientated at right angles to the wires, but so that a fence wire may not pass through the aperture when the arms are located generally parallel to the fence wires.

6. A fence dropper as claimed in claim 5, wherein at the top wire of the fence, the loop extends downwardly, so that the necked aperture opens downwardly, and at the bottom wire of the fence, the loop extends upwardly, so that the necked aperture opens upwardly.

7. A fence dropper as claimed in claim 1, wherein the loops at the top and bottom wires of the fence are spaced from the central portion to define a respective aperture between the central portion of the fence dropper and the respective loop;

the arms projecting in a direction from the respective loops such that with the top fence wire in the aperture at the top loop and the bottom fence wire in the aperture at the bottom loop and with the fence dropper orientated such that the arms extend parallel to the wires, the loops being orientated to engage the top and bottom wires both by means of the loops and the central portion for vertically restraining the fence wires in the apertures, but with the fence dropper orientated such that the central portion is rotated such that the arms are not parallel to the wires, the loops and the central portion being orientated such that the wires in the apertures between the loops and the central portion are not restrained by the central portion and the loops, whereby the fence dropper is free to be shifted longitudinally along the top and bottom wires.

* * * * *